US006203417B1

(12) United States Patent
Dyer et al.

(10) Patent No.: US 6,203,417 B1
(45) Date of Patent: Mar. 20, 2001

(54) CHEMICAL MECHANICAL POLISHING TOOL COMPONENTS WITH IMPROVED CORROSION RESISTANCE

(75) Inventors: Timothy S. Dyer, Tempe; John F. Stumpf, Phoenix, both of AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/434,650

(22) Filed: Nov. 5, 1999

(51) Int. Cl.[7] ..... B23F 21/03; B23F 21/23; B24B 33/00

(52) U.S. Cl. ..... 451/548; 451/41

(58) Field of Search ..... 451/28, 41, 905, 451/287, 288, 290, 548, 550

(56) References Cited

U.S. PATENT DOCUMENTS 4,484,418 * 11/1984 Reich et al. ..... 451/488

5,743,788 4/1998 Vanell ..... 451/41

* cited by examiner

*Primary Examiner*—Derris H. Banks
(74) *Attorney, Agent, or Firm*—Snell & Wilmer LLP

(57) ABSTRACT

Components of chemical, mechanical, polishing apparatus with components resistant to chemical attack by chemical slurries used in the polishing of semiconductor wafers. Among the components that are improved to enhance resistance to chemical attack are the polishing platen, pad conditioning end effectors, various subassemblies, housings for instrumentation, carrier rinse station surfaces, and other components that come into contact with a slurry. The coating compositions are preferably tightly adherent to the underlying substrate, and may be applied by a wide range of techniques. Especially useful are coatings such as tungsten carbide, tungsten nitride, amorphous diamond like carbon, and other such inert wear resistant coatings.

10 Claims, 2 Drawing Sheets

CHEMICAL MECHANICAL POLISHING TOOL COMPONENTS WITH IMPROVED CORROSION RESISTANCE

BACKGROUND OF THE INVENTION

1. Field of Invention

The invention relates to the fabrication of semiconductors, and more particularly to equipment using chemical mechanical polishing techniques. The invention provides a platen and other components for chemical mechanical polishing apparatus that are resistant to corrosive conditions encountered in the polishing process.

2. Background of the Related Art

In the fabrication of semiconductors, thin wafers of silicon are subject to a series of processes that create a plurality of semiconductors on the wafer surface. Some of these steps may, for example, etch the silicon surface, while others deposit semiconductor component layers using techniques that form thin film layers, like chemical or physical vapor deposition, ion implantation, and the like. At certain intervals in the manufacturing process, the surface of the semiconductor wafer must be polished in order to planarize the surface, and/or to selectively remove certain surface features. Generally, this polishing step is carried out using "chemical mechanical polishing' apparatus and techniques.

In CMP fabrication techniques, a free abrasive chemical slurry is often used along with a rotating polishing pad, linear polishing belt, or rotating drum to contact the workpiece surface and to polish and planarize that surface. Typical examples of these types of apparatus are described in U.S. Pat. No. 5,329,732, assigned to SpeedFam-IPEC disclosing a rotating polishing pad polisher; PCT Publication WO 97/20660, assigned to Applied Materials disclosing a linear belt polisher; and U.S. Pat. No. 5,643,056, assigned to Ebara Corporation and Kabushiki Kaisha Toshiba disclosing a rotating drum polisher. The disclosures of the foregoing patents, in relevant part, are incorporated herein, by reference.

As pointed out above, in chemical mechanical polishing, also known as "CMP", a chemical abrasive slurry is frequently used. The slurry is selected based on its properties, to facilitate the selective removal of the particular materials to be polished from the wafer surface. Thus, while most slurries contain fine abrasive particles such as alumina or silica, other slurry chemistry may vary widely. For example, a slurry may have a pH in the range from about 1 (highly acidic) to about 12–13 (highly alkaline). Certain components of the CMP apparatus are inevitably exposed to this slurry, that is both abrasive and potentially corrosive, depending upon its chemistry.

In addition, as might be expected, a polishing process generates heat due to polishing friction. Ordinarily, parts of the apparatus exposed to this friction-generated heat are sufficiently massive or composed of a material with high specific heat so as to provide a heat sink so that the temperature of the apparatus does not increase significantly. For example, FIG. 1 is an illustrative embodiment of a portion of a CMP apparatus that includes a platen 110, with an outer surface 120, mounted to a platen support structure or water jacket 140, that is fixed or rotating. A polishing pad 150 is mounted to the platen outer surface 120. A semiconductor wafer is secured to a wafer carrier 160, that is located adjacent the polishing pad 150 so that the pad can polish a wafer held in the wafer carrier 160, when the pad is brought into contact with the wafer.

The platen 110 is typically constructed of aluminum, stainless steel, Inconel®, ceramics, and the like. The type of material of construction, and platen design, are constrained by mechanical and thermal considerations. For example, temperature changes must be minimized to reduce dimensional changes that might occur with temperature change. The CMP process must be able to polish wafer surfaces to within fine tolerances, of the order of a few microns. Accordingly, dimensional stability of the platen is desirable and necessary. Further, temperature increase may affect the reactivity of chemicals of the abrasive slurry, and may contribute to undesirable side effects, such as reduced selectivity, or faster than expected polishing rates.

With regard to temperature control, platens may be divided into active and passive systems. In passive systems, there is provided a component with a large thermal inertia, often a material with high specific heat, so that heat generated by the polishing process is absorbed without significant temperature change. On the other hand, active systems remove the frictional heat generated by use of a "chiller", heat exchanger, or other suitable means.

The use of active heat removal systems is preferred, because these systems have lower mass, adjustable controls, better process parameter ranges, and lower costs than passive systems. The most common material for platens in active systems is aluminum, due to its high strength, low mass, and good thermal conductivity. Aluminums high thermal conductivity, coupled with its high thermal expansion coefficient, requires that temperatures be precisely controlled to limit warping of the platen, with resultant deleterious effect on polishing. Aluminum also has the disadvantage that it is amphoteric—i.e., it is susceptible to corrosion by both acidic and basic slurry components. Moreover, aluminum oxidizes readily in the presence of water.

Chemicals contained in the abrasive slurries, and the use of deionized water (in the rinsing) contribute to enhancing corrosion of the materials and components of equipment. Further, microscopic components released from the equipment due to the corrosion process results in contaminated wafers and defective semiconductor devices. If significant corrosion of the equipment results from the action of chemicals, the equipment component must be replaced. This incurs both equipment repair costs as well as loss of equipment use (down time), both of which are undesirable.

In the past, others have tried to address the issue of corrosion through use of a refractory metal oxide coating. For example, U.S. Pat. No. 5,743,788 shows the use of metal oxide compounds. However, these coatings are brittle and pose issues with regard to impact resistance, impurities, porosity, and matching thermal expansion with the underlying substrate. Further, the coatings have a relatively low adhesion strength which, combined with the brittleness and thermal expansion matching issues, result in excessive stress at the interface between the coating layer and the underlying platen substrate. These stresses ultimately result in delamination of the coating from the substrate, or cracking of the coating. Moreover, aluminum is a common platen material and its oxides are only stable in the pH range about 5.5 to about 9. Therefore, aluminum oxide coating is not suitable for acidic or highly alkaline slurries.

Attempts have also been made to use anodizing and polymer coatings (epoxy paints) as coating materials to protect exposed components of the CMP equipment from chemical attack. These have found limited application in CMP.

SUMMARY OF THE INVENTION

This summary of invention section is intended to introduce the reader to aspects of the invention and is not a complete description of the invention. Particular aspects of the invention are pointed out in other sections hereinbelow, and the invention is set forth in the appended claims which alone demarcate its scope.

The invention provides a chemical mechanical polishing apparatus with components that are resistant to chemical attack by chemical slurries used in the chemical mechanical polishing process. Among the components that are improved to enhance resistance to chemical attack are the polishing platen, pad conditioning end effectors, carrier subassemblies, housings for polishing metrology instrumentation, carrier rinse station surfaces, and other components that come into contact with the slurry.

In accordance with the invention, the components of the CMP apparatus are coated with a self repairing composition that is resistant to attack by the chemical slurry. Since certain slurries are highly acidic, while others might be highly alkaline, the compositions are preferably carefully selected to be resistant to both kinds of slurry. Further, the coating compositions are preferably tightly adherent to the underlying substrate from which the component is fabricated, so that the coating will not readily separate (spall or chip) from the substrate. The preferred coatings are of the general formula: $M_1C\text{-}M_2\ M_3$.

The coatings may be applied by any of a wide range of techniques, some of which are discussed herein. Moreover, the coatings are optionally machineable to provide close tolerances, if desired for particular applications.

In one aspect, the coatings are self repairing in the sense that when the coating is scratched, it will "grow" to cover the exposed area. Thus, the coatings provide a significant advantage in maintenance and in prolonging the life of tool components. Moreover, contamination of wafers or other substrates being polished with corrosion by-products is significantly reduced. Accordingly, the invention provides significant economic benefits.

BRIEF DESCRIPTION OF THE DRAWINGS

The following drawings are illustrative of embodiments of the invention and therefore do not limit the scope of the invention, but may assist in a proper understanding of the invention. The drawings are not to scale and are intended for use in conjunction with the explanations in the following detailed description section.

DETAILED DESCRIPTION OF THE PREFERRED EMBODIMENTS

This section illustrates aspects of the invention, and points out certain preferred embodiments of these aspects. This section is not intended to be exhaustive, but rather to inform and teach the person of skill in the art who will come to appreciate more fully other aspects, equivalents, and possibilities presented by the invention, and hence the scope of the invention as set forth in the claims which alone limit its scope.

In accordance with the invention, there is provided a chemical mechanical polishing apparatus with components that are resistant to chemical attack by abrasive slurries used in chemical mechanical polishing processes. More particularly, the invention provides coated CMP apparatus components. The coatings, which may be made by any of several processes, are preferably tightly adhered to the underlying components substrate, and are chemically resistant to slurries in the pH range from about 1 to about 14.

In the specification and claims, the term "chemically resistant," with reference to slurries used in chemical mechanical polishing processes, refers to coatings and compositions that do not present visible signs of chemical attack by the chemical slurry over a prolonged period of use (i.e., typically over a period of about one to about ten years), in comparison with uncoated components. While some level of chemical attack may be evident from a microscopic view of the coatings, for example through scanning electron microscope photographs, to the extent that such attack does not impair the integrity of the coating or permit attack of the underlying component substrate, the coating would be regarded as "resistant to chemical attack" in accordance with the terminology of the specification and claims.

The term "tightly adherent" as used to describe the coatings of the present invention indicate that the coatings adhere tenaciously to the underlying substrate, and are not readily separated by chemical attack or through the rigors of ordinary use over the life of the component. The tightly adherent coatings may be applied by any of several known coating techniques, including chemical or physical vapor deposition, coating by spraying or applying to the surface, and other techniques that will provide a tightly adherent coating.

Figure 1:
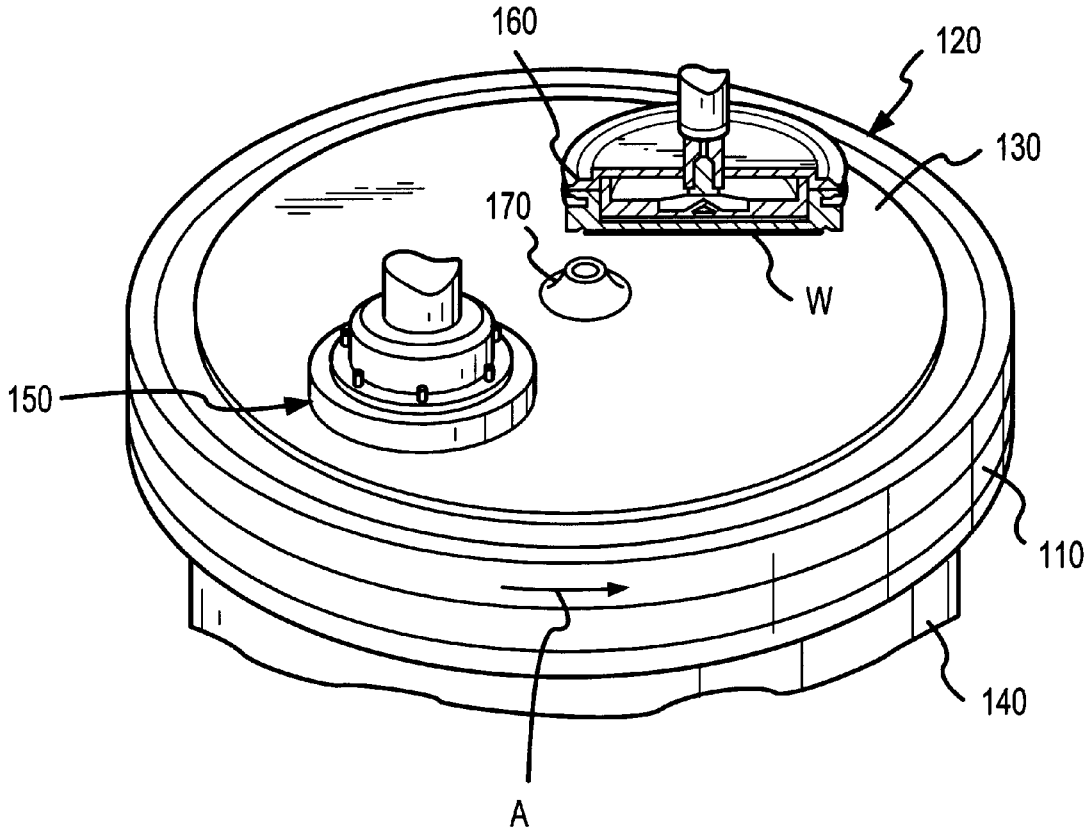
(PRIOR ART) FIG.1
FIG. 1 is a perspective view of a prior art CMP apparatus.
Figure 2:
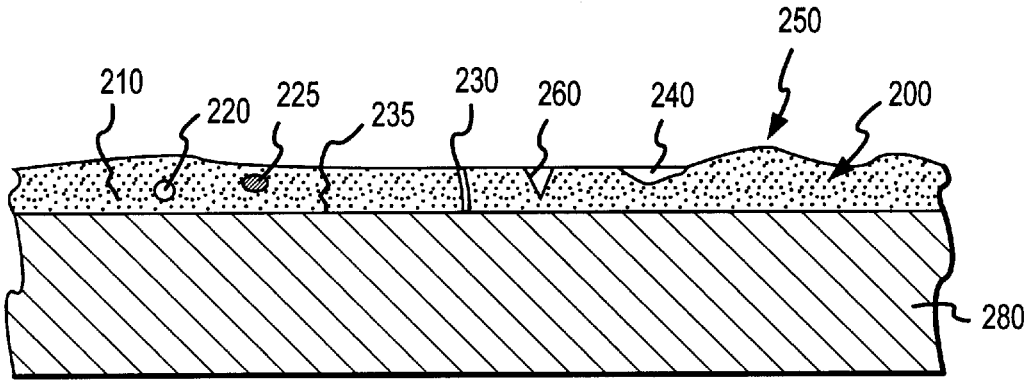
(PRIOR ART) FIG.2
FIG. 2 is a cross-sectional view of a platen coated using prior art methods.

As shown in FIG. 2, an illustrative portion of a cross-sectional view, highly magnified, of a prior art coated platen 280, the coating 200 has several types of defects. These defects may include cracks 210, pits 240, voids 220, inclusions 225, pores 230, or grain boundary defects 235. Other defects may arise from scratching, abrasion, or chipping 260 during operation or maintenance of the apparatus. The application of a protective film over the coating may result in a film that has uneven areas 250 that result from non-uniform deposition or buckling of the underlying coating 200 due to stresses. Once the corrosion process is initiated at any one of the above defects, it may be expected that corrosion will spread into and under the protective coating to cause deterioration of the underlying platen metal.

Figure 3:
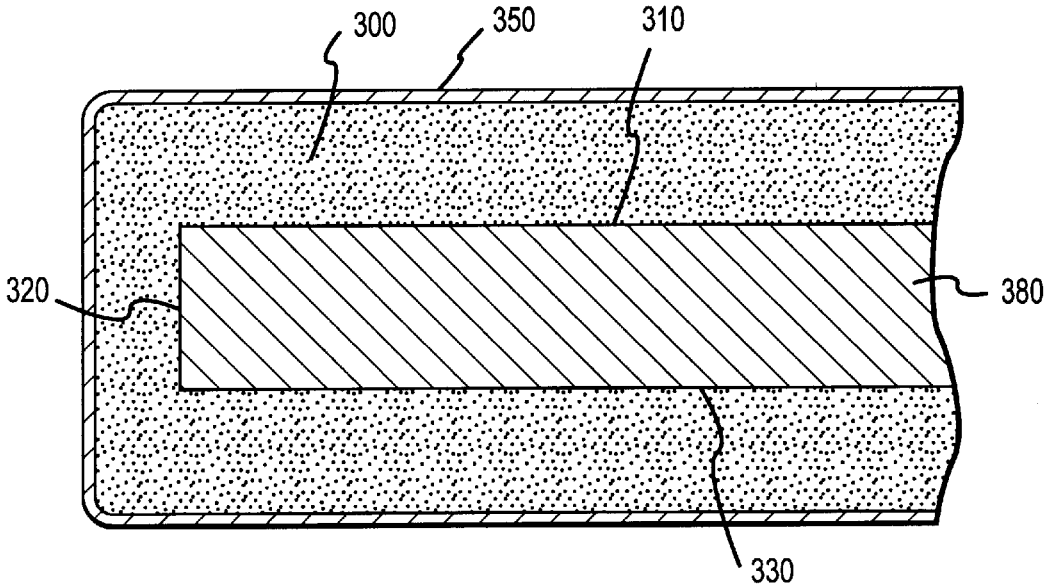
FIG. 3 is a cross-sectional view of a section of a platen according to an embodiment of the present invention.

In contrast, FIG. 3 is a schematic cross-sectional view of a portion of a platen coated with a protective coating, in accordance with an embodiment of the invention. The coating 300 is deposited onto the platen 380. The platen 380 may be made of a suitable metal, such as aluminum, aluminum alloy, stainless steel, or another preferably highly thermally conductive metal for ease of frictional heat dissipation. The protective coating layer 300 is formed, coated or deposited onto all of the exposed surfaces of the platen 380, although such complete coating may not be necessary in all instances. In accordance with the invention, it is only necessary that those portions of the surface exposed to the chemical slurry be coated.

In general, surface preparation for coating is dependent upon the type of process used to form or deposit the coating. In most instances, special preparation is not required, although the surface may bleated, for example by be grit blasting to provide increased surface roughness to enhance adhesion of the coating to the surface.

The chemically resistant coatings of the invention may include any of those coatings that are resistant to chemical attack by the abrasive slurries used in chemical mechanical polishing. In particular, the coatings are self repairing in the sense that when scratched, the coating will "grow" and cover the scratched area, as long as the scratch-exposed area is not excessively large. The preferred coatings are of the formula $M_1C$-$M_2$-$M_3$, where:

$M_1C$ is a carbide of a refractory metal, for example tungsten, tantalum, zirconium, titanium, and niobium.

$M_2$ is preferably a metal that forms an oxide that is stable in a high pH environment, for example, nickel, chrome, manganese, and the like. Chrome is preferred.

$M_3$ is selected from metals that are compatible with $M_2$ in the sense of providing stability to the composition, and may be characterized as a "binder metal". It has resistance to high pH corrosion, and prepared metals are iron and cobalt. It preferably comprises about 2 to about 5 wt % of the coating composition.

A most preferred coating is WC—Co—Cr, although other carbide-based coatings are also useful.

These preferred coatings are self repairing and machineable, when applied in a sufficiently thick layer. Typically, the coatings are at least about 100 microns thick, and preferably in the range about 0.05 to about 1.0 mm thick. However coatings could be thicker, particularly in those cases where it is necessary or desirable to machine the coating, such as when it is applied to a platen surface. Machining may be by any useful procedure including polishing and grinding, for example.

In addition, other coatings are also useful, such as tungsten carbide, tungsten nitride, diamond-like amorphus carbon, and like hard coatings. Some of these, however, are not self repairing or machineable, like the preferred coatings.

Further, the coatings of the invention may optionally be covered by a second coating or "protective film." The protective film not only covers the underlying coating, but may fill any surface irregularities, such as cracks or voids. The film is preferably an organic polymer that is resistant to chemical attack by the slurry and that resists the ordinary rigors of use of the component for a useful length of time. Such chemical films may be formed from polymeric compositions such as polytetrafluoroethylene, polyaryletherketone, spin-on-glass, polyimide, and other commercially available polymers that are known to be chemically resistant and that can be deposited as adherent films on the coatings.

In one example of an embodiment of the present invention, a coating of tungsten carbide may be applied using high velocity oxy-fuel techniques ("HVOF"). When the coating is made of tungsten carbide, and is applied to a platen surface, the preferred coating thickness is in the range from about 0.05 mm to about 1.0 mm, most preferably about 0.25 mm. The coating may then be finished (such as by grinding or polishing) to provide a smooth surface.

The application of a tungsten carbide coating using the HVOF system may be applied to a CMP apparatus component using the HVOF unit manufactured by Hobart Tafa of 146 Pembroke Road, Concord N.H. This unit uses an oxygen-fuel mixture consisting of propylene, propane, or hydrogen. Fuel gases are mixed in a siphon system in the front portion of the HVOF gun. The mixed gases are ejected from the gun's nozzle and ignited to form a circular flame that surrounds powdered coating material flowing through the gun. Combustion temperature ranges from about 4000 to about 6000 degrees Fahrenheit (about 2000 to about 3500 degrees centigrade). The circular flame shapes the powder stream to provide uniform heating, melting and acceleration of the materials to be deposited on the CMP component. Predetermined oxygen, fuel and quantities are specified for each material to optimize dwell time in the flame.

HVOF applied coatings have high density, even deposition, and negligible porosity. Coatings applied by this process, that delivers material at velocities in excess of 7000 feet per second (about 2150 m/s), have bond strengths greater than 12,000 psi (about $8.25\times10^7$ Nt/m$^2$). Thus, the high velocity particles are virtually imbedded into the component to form a tightly adherent coating. In the case of tungsten carbide, the coating is of high density, high bond strength (greater than 12,000 psi) and stable in the pH range from less than about 2 up to about 13.5. The coating has high thermal conductivity and negligible porosity. It is ductile, and essentially stress free with a high hardness (tungsten carbide-chrome-cobalt alloys have Vickers of 1100, compared to 850 for aluminum oxide). The coating can be applied in sufficient thickness to allow for finishing and wear expected in use. Moreover, the coating process has low thermal input (the component temperature is less than 300 degrees Fahrenheit (150 degrees centigrade), insuring original mechanical properties and eliminating the requirement for stress relieving.

Glow Discharge Mass Spectroscopy (GDMS) tests show that the tungsten carbide HVOF-applied coating alloys are free of significant contaminating species, and contain low concentrations of tantalum, titanium, niobium, nickel, iron and copper (less than 1% for all contaminants combined). The concentration of mobile ions (sodium, potassium and lithium) was less than 30 ppm total. X-ray diffraction analysis showed that the coating was consistently hexagonal tungsten carbide with some free tungsten.

The foregoing description provides an enabling disclosure of the invention, which is not limited by the description but only by the scope of the appended claims. All of those other aspects of the invention, and their equivalents, that will become apparent with a person of skill in the art who has read the foregoing, are within the scope of the invention and of the claims hereinbelow.

What is claimed is:

1. An improvement in chemical mechanical polishing apparatus, the apparatus comprising a platen with a pad mounted on a surface thereof, and a carrier with a first side for holding a silicon wafer, the first side of the carrier facing the pad to facilitate polishing a wafer held in the carrier against the pad with a chemical slurry, the improvement comprising:

the platen having a tightly adhered, self repairing coating on surfaces exposed to the slurry, the coating resistant to chemical reaction with the chemical slurry.

2. An improvement in chemical mechanical polishing apparatus, the apparatus comprising a platen with a pad mounted on a surface thereof, and a carrier with a first side for holding a silicon wafer, the first side of the carrier facing the pad to facilitate polishing a wafer held in the carrier against the pad with a chemical slurry, the improvement comprising:

the platen having a self repairing, machinable, tightly adhered coating on surfaces exposed to the slurry, the coating resistant to reaction with the chemical slurry.

3. An improvement in a chemical mechanical polishing apparatus, the apparatus comprising components exposed to contact with a chemical slurry, the improvement comprising:

at least some of the components having a self repairing coating resistant to chemical reaction with the chemical slurry.

4. The apparatus of claims 1, 2 or 3 wherein the tightly adhered coating is selected from the group consisting of the coatings of the general formula: $M_1C$-$M_2$-$M_3$, where:

$M_1C$ is selected from W, Ta, Zr, Ti and Nb;

$M_2$ is selected from Ni, Cr, Mn; and $M_3$ is selected from Co and Fe.

5. The apparatus of claims 1, 2 or 3, wherein the coating is at least partially covered by a sealant layer formed of a polymeric composition resistant to chemical attack by the slurry.

6. The apparatus of claims 1, 2 or 3 wherein the coating is at least partially covered with a sealant layer, the sealant layer comprising polytetrafluoroethylene, polyaryletherketone, polyimide or spin on glass.

7. The apparatus of claim 1, 2 or 3 wherein the coating is from about 0.05 to about 1 mm thick.

8. The apparatus of claim 1,2 or 3 where in the coating is machined.

9. The apparatus of claim 1, 2 or 3 wherein the coating is applied by a high velocity oxy-fuel method.

10. A chemical mechanical polishing apparatus comprising:

(a) a carrier for holding a wafer to be polished;

(b) means for supplying slurry to a wafer surface when the wafer is in the carrier undergoing polishing; and (c) components of the apparatus exposed to chemical slurry when the apparatus is in use, at least some of the components comprising a coating over at least surfaces exposed to the slurry during use of the apparatus wherein the coating is self resistant to chemical attack by the slurry and wherein the coating is selected from the group consisting of the coatings of the general formula: $M_1C$-$M_2$-$M_3$, where:

$M_1C$ is selected from W, Ta, Zr, Ti and Nb;

$M_2$ is selected from Ni, Cr, Mn; and $M_3$ is selected from Co and Fe.

* * * * *